United States Patent [19]

Segal

[11] Patent Number: 4,867,335

[45] Date of Patent: Sep. 19, 1989

[54] TIMING-CHAIN COVER CAP

[75] Inventor: William J. Segal, Torrance, Calif.

[73] Assignee: Mr. Gasket Company, Cleveland, Ohio

[21] Appl. No.: 277,775

[22] Filed: Nov. 30, 1988

[51] Int. Cl.[4] ..... B65D 45/00

[52] U.S. Cl. ..... 220/327; 123/198 E

[58] Field of Search ..... 220/327; 123/198 E; 180/84; 280/152.1

[56] References Cited

U.S. PATENT DOCUMENTS 3,925,872 12/1975 McDaniel ..... 29/267

4,261,310 4/1981 Laws, Jr. ..... 123/198 E 4,480,609 11/1984 Hayashi ..... 123/195 C

*Primary Examiner*—Stephen Marcus

*Assistant Examiner*—Nova Stucker

*Attorney, Agent, or Firm*—Bpdy, Vickers & Daniels

[57] ABSTRACT

A timing-chain cover cap for a timing-chain cover comprising a generally semi elliptical cap body, the upper portion thereof being in circular shape while the lower portion thereof being in arcuate shape, and the bottom of the cap body is encircled by an integerally formed locating plate member except that part beneath the arcuate portion. By means of a plurality of holes provided on said locating plate member, the cap body can be threadingly fitted onto the timing-chain cover.

6 Claims, 6 Drawing Sheets

PRIOR ART

TIMING-CHAIN COVER CAP

The present invention relates to an improved cap for a timing-chain cover having uniquely new structure and allowing simple and easy mounting on the timing-chain cover of a motor.

In conventional cover caps (see FIG. 1), prior to being mmounted on the timing-chain cover, it is necessary to take the trouble to have the water pump, the vibration damper, the drive belt and the oil pan removed. In addition, after the cover cap has been mounted, new gaskets have to be replaced before the above-mentioned parts are reinstalled. It takes about four to six hours to perform such complicated practice, so it is not only time-consuming but also costly.

It is, therefore, an object of the present invention to provide an improved cover cap which overcomes the disadvantages of the conventional cover caps and which can be simply and easily installed on the timing-chain cover.

The present invention will now be described in greater detail with reference to the accompanying drawings in which.

Figure 1:
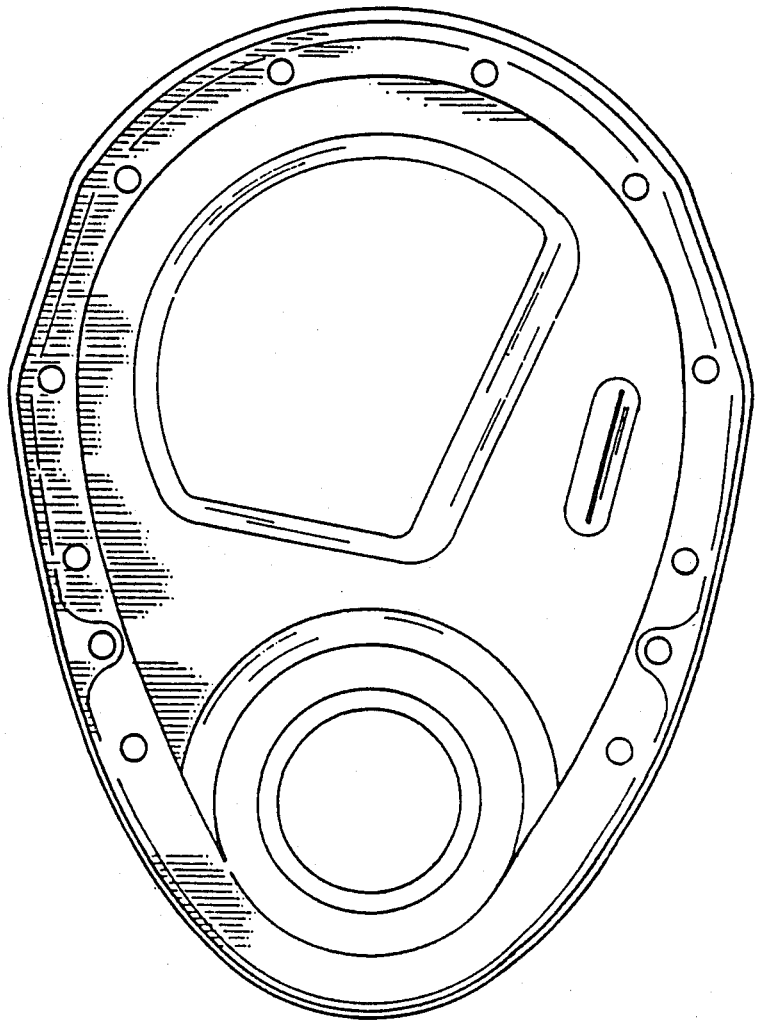
FIG. 1 shows a conventional cover cap.
Figure 2:
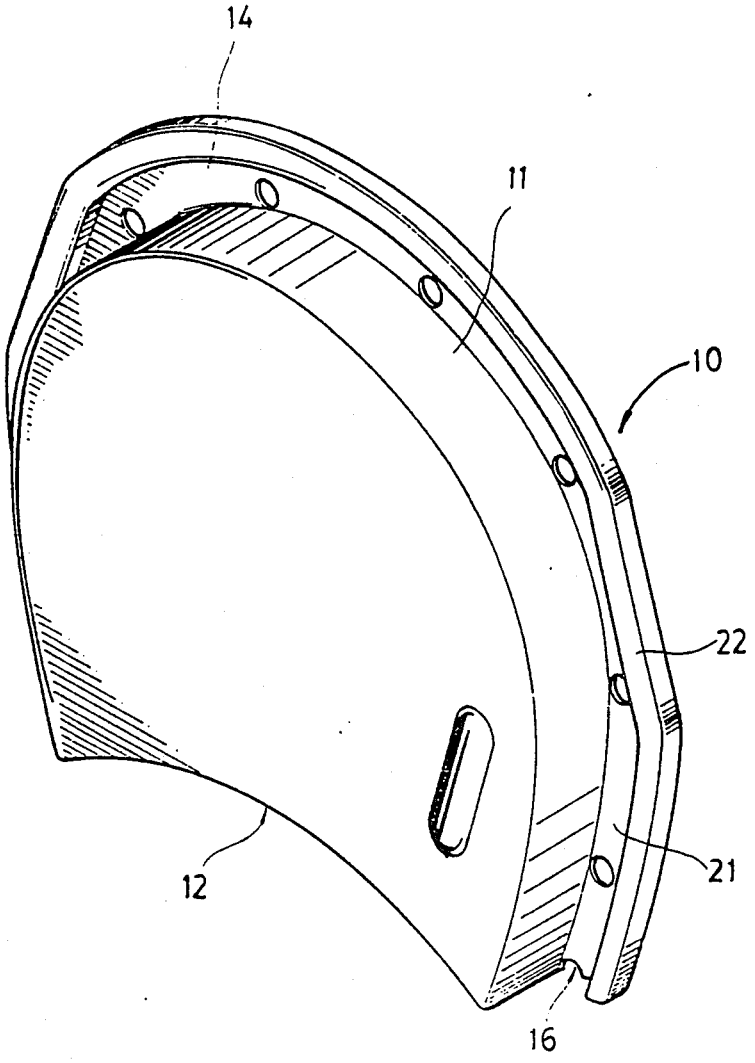
FIG. 2 is a perspective view of the cover cap according to the present invention.
Figure 3:
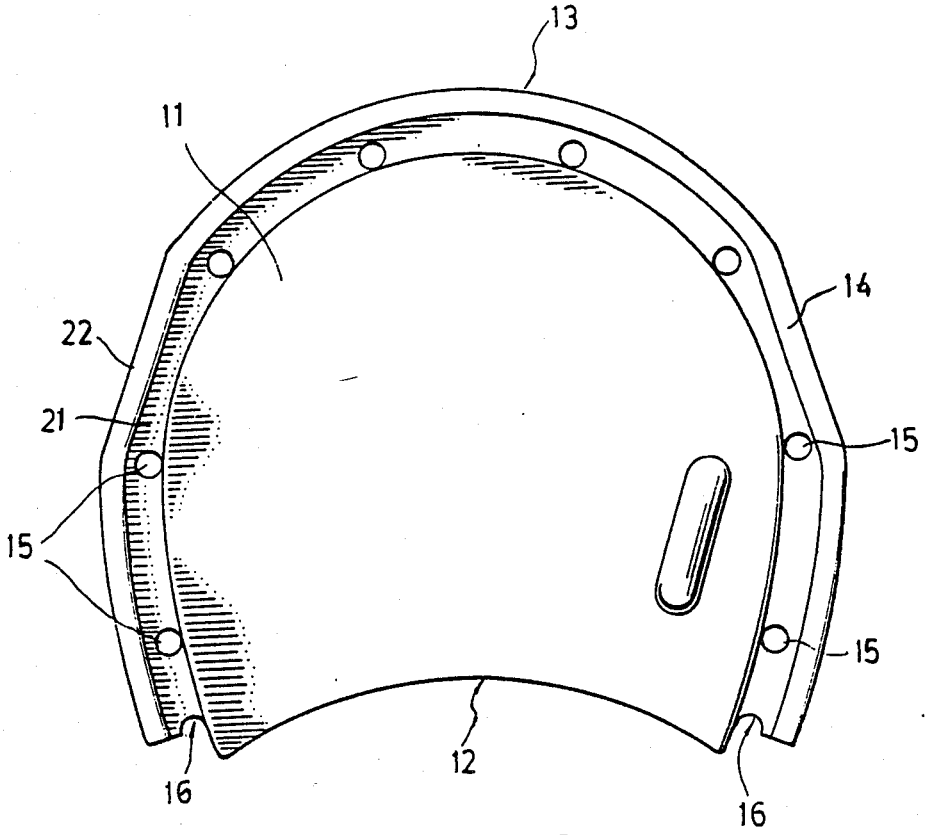
FIG. 3 is a front elevation view of the present invention.
Figure 4:
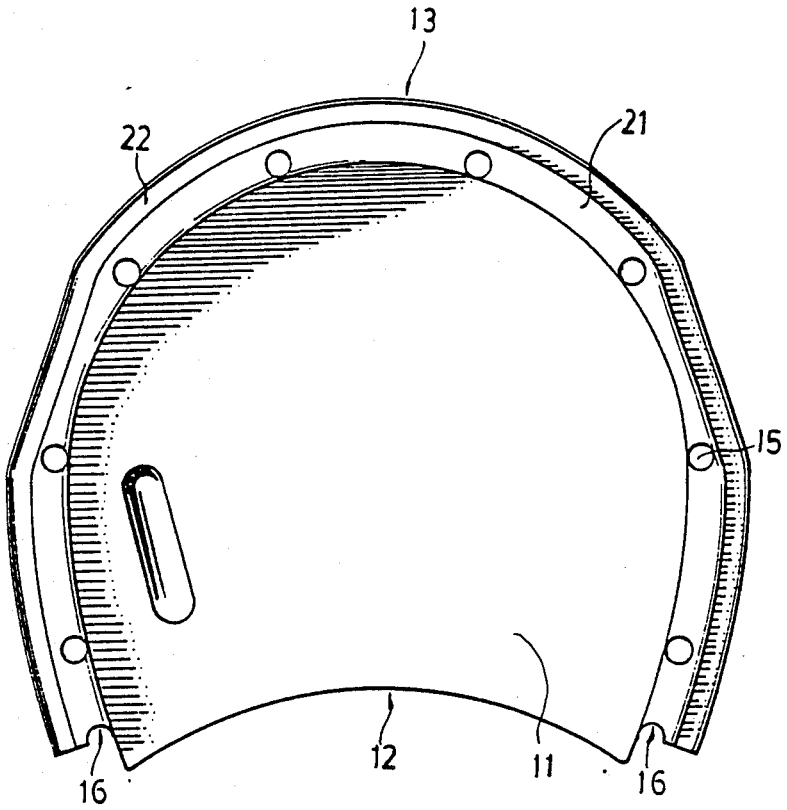
FIG. 4 is a rear elevation view of the present invention.

As shown in FIGS. 2, 3 and 4, the cover cap (10) is comprised of an integrally formed cap body (11). As compared with conventional cap bodies, the cap body of the present invention is substantially half the size of the conventional ones, the cap body (11) being generally semi eliptically shaped shaped with the upper portion in smooth circular shape (13) and the lower portion in arcuate shape (12). The bottom portion of the cap body (11 is encircled by an integrally formed locating plate member (14) which comprises an inner side strip (21) and an outer side strip (22), a plurality of holes, spaced apart relative to each other, being symmetrically provided at suitable positions on the inner side strip (21); in the present embodiment, four holes being provided on both left and right sides, respectively. The ends of both sides of the inner side strip (21) terminate in a circular arc (16) of small radius.

As clearly shown in FIG. 4, the outer side strip (22) of the locating plate member (14) is constructed in the shape of a groove, such that the cap body (11) can be snugly embedded in the timing-chain cover (30) of the motor (20) (see FIG. 5), because the outer periphery of the timing-chain cover is provided with a protruding annular strip (not shown) to match the locating plate member (14).

Figure 5:
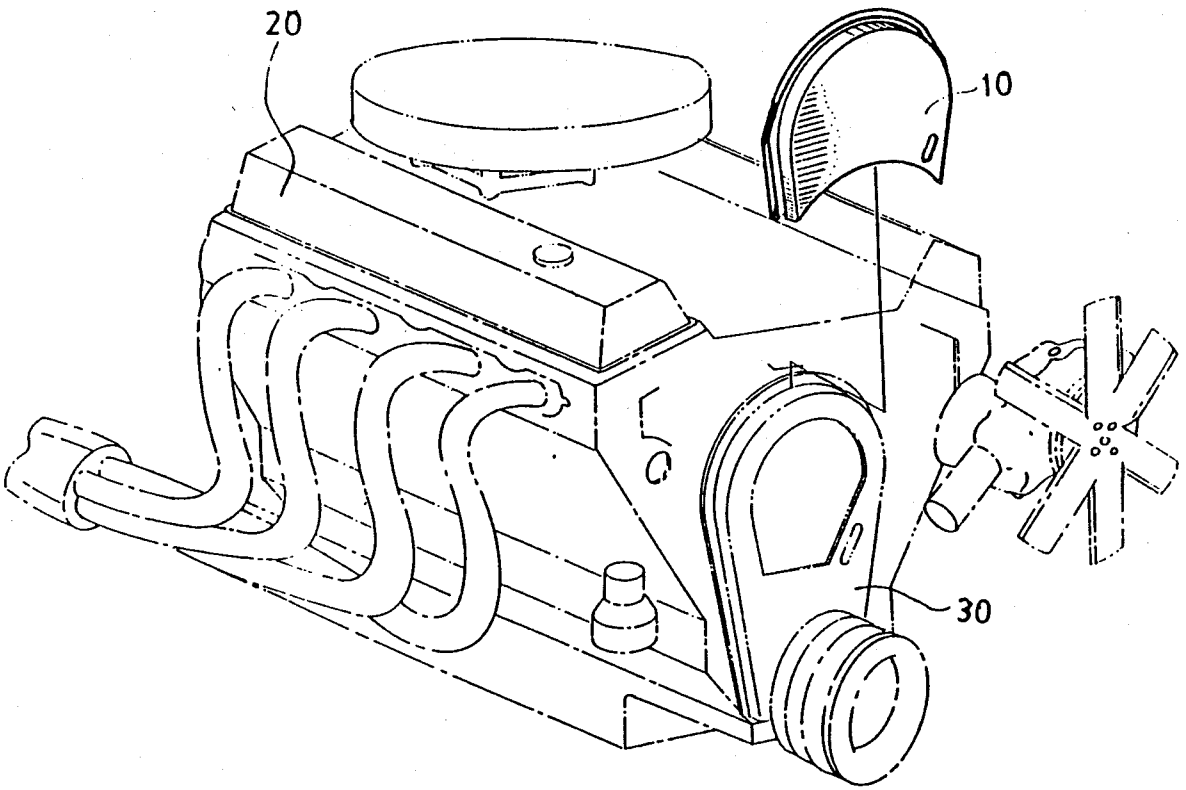
FIG. 5 is a view showing the present invention in use.
Figure 6:
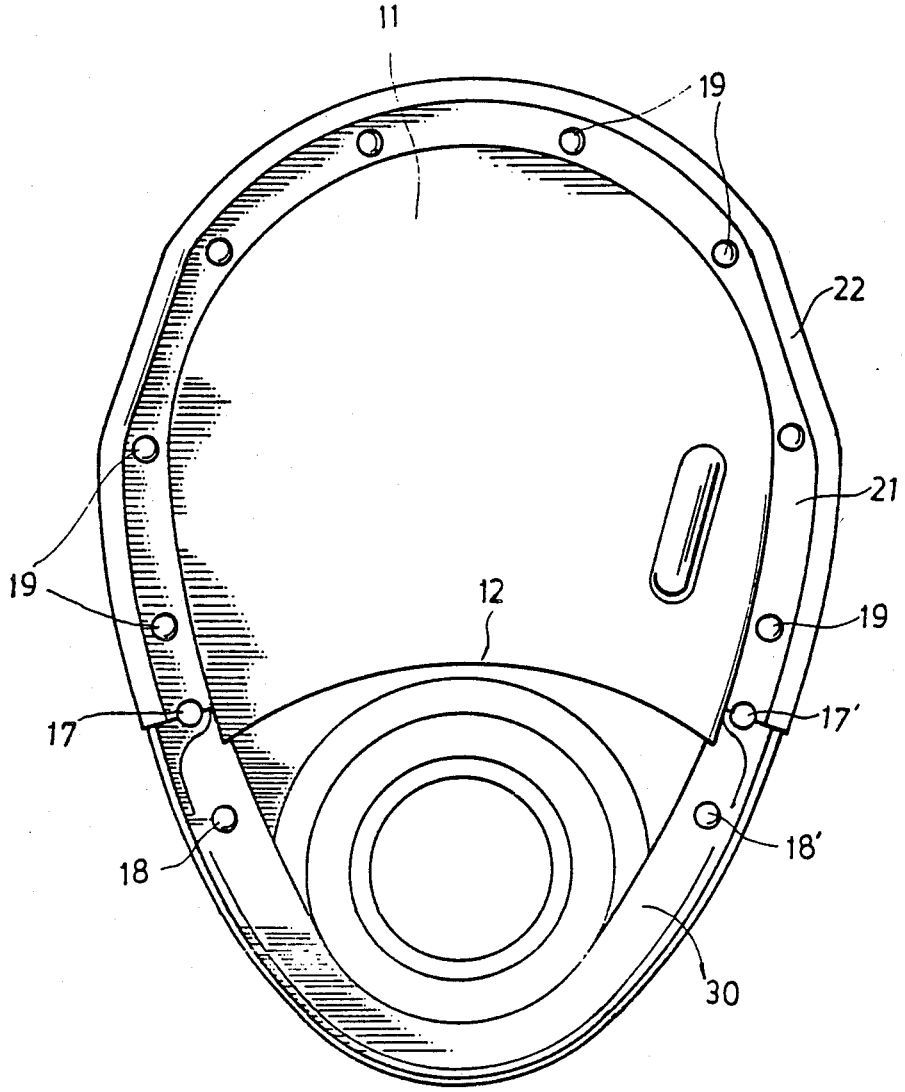
FIG. 6 is an elevation view showing the present invention as assembled to a timing-chain cover.

In FIG. 5, there is shown the present "cover cap" mounted on the timing-chain cover (30). As can be clearly seen, the cap body (11) of the present invention is only half the size of a conventional cap body such that, during installation, the lower portion thereof does not touch the drive belt and the oil pan. Therefore, when mounting the cap of the present invention on the timing-chain cover, it is necessary only to remove the eight bolts (19) (see FIG. 6) that hold the timing-chain cover (30) in place (it is not necessary to remove the bolts (18, 18') beneath the locating pins (17 17'), respectively) and then the cap body (11) can be mounted on the timing-chain cover (30), except that in certain cases it is required to remove the water pump in order that the cap of the present invention can be slid to fit into the timing-chain cover. Care should be taken to align the holes (15) on the cap body (11) with the threaded holes on the timing-chain cover (30) such that both the cap body (11) and the timing-chain cover (30) can be securely embedded on the motor (20) by means of the eight bolts. The circular arcs (16) on the end of inner side strip (21) of the locating plate member (14) are so designed that, during installation, they are in close engagement with the upper ends of the locating pins (17,17') that hold the timing-chain cover (30) in position. By means of such design, installation of the present invention is made further simpler and easier. The entire mounting procedure takes about half to one hour.

The description herein is intended only to exemplify the practice of the present invention. The above description of the embodiment of the invention should not be construed as limitative to the scope of the present invention. It is apparent to those skilled in the art that various changes and modifications can be made to the cover cap of the present invention as described in the above embodiment without departing from the principles and scope of the invention.

I claim:

1. A cap for an engine timing-chain cover comprising:

a body member having a generally semi-elliptical peripheral ouline including two lower corners, a generally semi-elliptical upper edge extending between said corners, and a lower edge extending between said corners in a configuration to be concave with respect to said body member; and, a locating plate member formed as a flange on said upper edge and including means for mounting said cap on said engine timing-chain cover.

2. A cap as defined in claim 1 wherein said engine timing-chain cover comprises mounting bolts, said locating plate member includes an inner side strip member adjoining said upper edge, and said mounting means includes a plurality of apertures spaced along said inner side strip member to align with said bolts.

3. A cap as defined in claim 2 wherein said engine timing-chain cover further includes a mounting element, and said locating plate member further includes an outer side strip member adjoining said inner strip member, said outer strip member being adapted to register with said mounting element.

4. A cap as defined in claim 3 wherein said mounting element is a protruding annular strip, and said outer side strip member has a channel shaped cross section adapted to closely fit over said protruding annular strip.

5. A cap as defined in claim 4 wherein said inner side strip member extends between two opposite end edges, and includes an arcuate recess at each said end edge.

6. A cap as defined in claim 5 wherein said end edges are closely adjacent to said two lower corners, and said outer side strip member is substantially co-extensive with said inner side strip member.

* * * * *